United States Patent [19]

Onuma et al.

[11] 4,405,703

[45] Sep. 20, 1983

[54] ELECTROPHOTOGRAPHIC PLATE HAVING AN AGE-HARDENED ALUMINUM SUBSTRATE AND PROCESS FOR PRODUCING THE SAME

[75] Inventors: Shigeharu Onuma; Kunihiro Tamahashi; Akira Hosoya, all of Hitachi; Atsushi Kakuta, Hitachiota; Yasuki Mori; Hirosada Morishita, both of Hitachi, all of Japan

[73] Assignees: Hitachi, Ltd.; Hitachi Koki Co., Ltd., both of Tokyo, Japan

[21] Appl. No.: 307,203

[22] Filed: Sep. 30, 1981

[30] Foreign Application Priority Data

Oct. 3, 1980 [JP] Japan ..... 55/137704

[51] Int. Cl.[3] ..... G03G 5/10

[52] U.S. Cl. ..... 430/69; 430/128; 430/130; 430/84

[58] Field of Search ..... 430/62, 63, 128, 130, 430/84; 423/115

[56] References Cited

U.S. PATENT DOCUMENTS 2,753,278 7/1956 Bixby et al. ..... 430/128

*Primary Examiner*—John E. Kittle
*Assistant Examiner*—John L. Goodrow
*Attorney, Agent, or Firm*—Antonelli, Terry & Wands

[57] ABSTRACT

In an electrophotographic plate comprising a substrate and a photoconductive layer formed on said substrate, when said substrate is made of an age-hardening type aluminum alloy and has a Vickers hardness of 60 Hv or higher, there can be produced electrophotographic plates high in dimensional accuracy, good in resistance to mechanical damages and impact, and very small in eccentricity when molded in the form of a drum. When the surface hardness of the selenium photoconductive layer is made 5 H or harder in pencil hardness, the resulting electrophotographic plate is excellent in printing performance and has a long life.

8 Claims, 6 Drawing Figures

ELECTROPHOTOGRAPHIC PLATE HAVING AN AGE-HARDENED ALUMINUM SUBSTRATE AND PROCESS FOR PRODUCING THE SAME

This invention relates to an electrophotographic plate comprising a substrate made from an age-hardening type aluminum alloy and a photoconductive layer formed thereon, and to a process for producing the same.

In electrophotographic printing techniques by the so-called xerographic method in which the electrostatic phenomenon and the photoconductive effect of a selenium photoconductive layer are combined, aluminum or alloys thereof (of non-age-hardening type) are mainly used as a substrate from the viewpoint of economy and easiness of handling. However, they are disadvantageous in that residual stress, distortion or the like takes place in the substrate and lowers dimensional precision of the substrate, and that when they are worked into a drum form, eccentricity occurs, resulting in lowering in the yield of products. Further, aluminum alloy substrates heretofore used have as low hardness as about 25–40 Hv (Vickers hardness), and hence are susceptible to mechanical damages. It has turned out from the researches done by the present inventors that in particular, scratches or unevenness or the like owing to bruises are made at the time of precise working and cause omission of words or misprinting at the time of printing after the adhesion of the photoconductive layer.

It is an object of this invention to provide an electrophotographic plate improved in dimensional accuracy and in yield in production by using an age-hardening type aluminum alloy as a substrate.

This invention provides an electrophotographic plate comprising a substrate made of an age-hardening type aluminum alloy having a surface hardness of 60 Hv or higher in terms of Vickers hardness and a photoconductive layer formed on the substrate. Further, this invention provides a process for producing an electrophotographic plate which comprises subjecting an age-hardening type aluminum alloy to age-hardening heat treatment to obtain a substrate having a hardness of 60 Hv or higher in terms of Vickers hardness, subjecting the surface of said substrate to precise working, vacuum-evaporating amorphous selenium or a selenium alloy onto said substrate surface to form a photoconductive layer, and then rapidly cooling the thus obtained substrate and photoconductive layer.

The substrate of the electrophotographic plate of this invention is made of an age-hardening type aluminum alloy having a hardness of 60 Hv or higher in terms of Vickers hardness. Aluminum alloys can broadly be divided into non-age-hardening type and age-hardening type, and the former is hardened by work hardening by plastic deformation, while the latter is hardened by age-hardening heat treatment.

When a substrate in drum form is used in an electrophotographic plate, it is required as universally known to be good in workability and undergo only a slightly dimensional change with the lapse of time and aluminum alloys are mainly used. Aluminum alloys are soft, and therefore when they are used as a substrate, there are, as methods for hardening them, work hardening by plastic deformation and age-hardening by heat treatment. However, between the methods for hardening a substrate, the former method, though it has heretofore been employed, causes a great dimensional change with the lapse of time and hence is unsuitable as a method for hardening the substrate. On the other hand, age-hardening type aluminum alloys to be used in this invention are advantageous in that they are light, good in workability, hardly cause dimensional change such as eccentricity or the like, and can be made to have a high hardness. Also the use of an age-hardening aluminum is expected to be suitable for the hereinafter mentioned cooling effect on the photoconductive layer.

When eccentricity takes place in a substrate of drum form, it should be made as slight as possible because when an electrophotographic plate having said substrate is set in a laser printer or the like, the eccentricity causes swing of the electrophotographic plate by rotation and lack in matching with other apparatus, and hence deteriorates the printig performance characteristics, for example, it makes the printing to be out of focus and causes unevenness in the printing.

As the age-hardening type aluminum alloys used in this invention, there are those shown in the following Table 1.

TABLE 1

| Kind | JIS mark | Remarks |
|---|---|---|
| Al—Cu alloys | Level of A2000 | Al—(1.5–5.0%)Cu<br>Slight amounts of Si, Mg, Mn and Ni are contained in addition thereto. |
| Al—Si—Mg—Ni alloys | A4032 | Al—(11.0–13.5%)Si—(0.8–1.3%)Mg—(0.15–1.3%)Ni |
| Al—Mg—Si alloys | Level of A6000 | Al—(0.45–1.2%)Mg—(0.2–1.2%)Si<br>A slight amount of Cr is contained in addition thereto. |
| Al—Mn—Mg—Zn alloys | Level of A7000 | Al—(0.20–0.9%)Mn—(1.0–2.9%)Mg—(3.8–6.1%)Zn<br>Slight amounts of Cu and Cr are contained in addition thereto |

Figure 1:
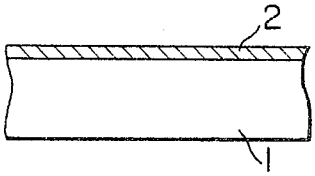
Figure 2:
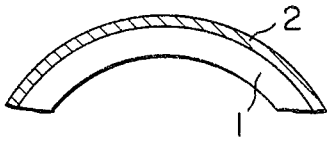

In the attached drawings,

FIG. 1 is a partial cross sectional view of the electrophotographic plate of this invention in flat form;

FIG. 2 is a partial cross-sectional view of the electrophotograhic plate of this invention in drum form;

Among these age-hardening type aluminum alloys, particularly preferably are those of Al-Mg-Si alloys (the level of JIS A6000) which require only a short age-hardening heat treatment time and are easy to form into drum form or plate form.

Figure 3:
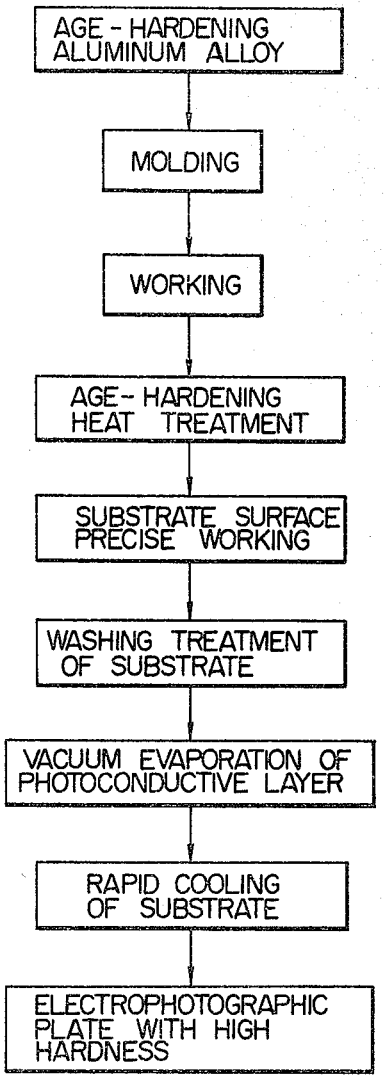
FIG. 3 is a flow sheet showing an example of a production process of the electrophotographic plate of this invention.

The substrate of an electrophotographic plate can be allowed to have a desired form such as a flat form shown in FIG. 1 or a drum form shown in FIG. 2 depending upon the intended applications. In FIGS. 1 and 2, numeral 1 denotes a substrate and numeral 2 denotes a photoconductive layer. Any of the above-mentioned age-hardening type aluminum alloys is molded into a desired form, worked to a nearly desired dimension, and then subjected to age-hardening heat treatment at 190° to 210° C. for 0.5 to 1 hour, after which the substrate surface is subjected to precise working so as to be specular and to finish the substrate to a desired dimension, and the substrate is subjected to washing treatment and then sent to the subsequent step of vacuum evaporation of the photoconductive layer. A series of these steps are shown in FIG. 3.

The hardness of the thus obtained substrate should be 60 Hv or higher in terms of Vickers hardness. By thus highly hardening the substrate, the following effects can be obtained.

(1) As compared with non-age-hardening type Al alloys, the age-hardening type Al alloys are subjected to age-hardening heat treatment in the course of working to a desired dimension, whereby the residual stress, distortion or the like owing to the working are reduced, and there can be obtained a substrate which is high in dimensional precision and, in particular, in which only slight eccentricity takes place.

(2) By the possibility of obtaining a substrate in which only slight eccentricity takes place, the alloys can be improved, as a substrate for an electrophotographic plate, in the yield in production, and are excellent in matching with apparatus such as a laser printer, a reprinter, and the like after the vacuum evaporation of the photoconductive layer, so that clear images can be provided.

(3) By the impartation of high hardness to the substrate, the substrate becomes excellent in resistance to mechanical damages and impact, and hence is improved in hardling performance characteristics.

(4) By the impartation of a hard photoconductive layer to the substrate, the electrophotographic plate to be obtained is improved in resistance to abrasion due to its contact with recording paper, cleaning of image-forming powder, or the like which is caused by setting it in an apparatus, and there is an increase in the printing property, so that the electrophotographic plate has a long life.

The material of the photoconductive layer to be formed on the substrate is not limited particularly, and organic photoconductive layers and the like can also be used. In the case of the xerographic method the photoconductive layer is made of amorphous selenium or a selenium alloy by a conventional vacuum evaporation method. As the selenium alloys, there may be used those which comprise selenium as the main constituent and contain tellurium, antimony, arsenic, and the like as additives.

The printing performance characteristics of the selenium photoconductive layer, particularly its life has become important simultaneously with the advent of a high-speed non-impact printer. That is to say, in application to a high-speed non-impact printer, selenium and selenium alloy photoconductive layers come in contact with toner and paper repeatedly at a high speed in electrophotographic printing processes such as the formation of latent images, transfer, and the like, so that the printing performance characteristics are deteriorated by mechanical damages, particularly scratches, bruises or the like of the photoconductive layer.

Therefore, even if these selenium and selenium alloy photoconductive layers are satisfactory in electrophotographic performance characteristics required for the photoconductive layer, damages influence the life of the electrophotographic plate if they are caused. These life factors are thought to result from low mechanical strength, i.e., low surface hardness of selenium and selenium alloy photoconductive layers. Really, the surface hardness was measured by a pencil hardness test method (hereinafter described in detail) employed in this art, to find that the surface hardnesses of conventional selenium photoconductive layers were at most about 4H and that mechanical damages were caused at the beginning of repeated use. Accordingly, the damages lowered the printing resistance of the photoconductive plate, so that its life was short. It is considered from this that in order to prolong the life of the electrophotographic plate, it is the most important improvement to further increase the surface hardness of the photoconductive layer.

The thickness of the photoconductive layer is usually 40 to 100 μm.

Figure 4:
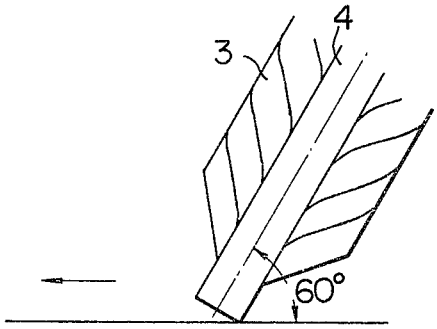
FIG. 4 is a sketch showing the pencil hardness test.

In order to improve the printing resistance of an electrophotographic plate and make its life long, it is necessary to increase the surface hardness of the photoconductive layer. For measuring the surface hardness of the selenium photoconductive layer, the Vickers hardness measuring method cannot be employed, and therefore a pencil hardness test method is employed. This is a method by which as shown in FIG. 4, pencils different from one another in hardness of the lead 4 surrounded by holder wood 3 are used, and the lead 4 whose point has been made plate is contacted with a photoconductor layer surface 5 at an angle of 60° C. and moved thereon in the direction of the arrow under pressure, and the highest hardness of the pencil at which said surface does not damaged or become uneven is defined as the surface hardness.

It was found in this invention for the first time that excellent printing resistance and life prolongation which have never been obtained could be obtained by making the surface hardness of the photoconductive layer 5H or higher in terms of the pencil hardness. As a result of various experiments, it was found that in order to obtain a photoconductive layer having a surface hardness of 5 H or higher in terms of the pencil hardness, it was necessary as one factor to adjust the hardness of the substrate to 60 Hv or higher in terms of Vickers hardness, and that it was necessary as another factor to rapidly cool at a cooling rate of 5° C./min or higher the substrate on which a photoconductive layer had been formed and which was obtained after vacuum evaporation.

The cooling rate is expressed in terms of an average rate of cooling the substrate from the temperature of substrate surface—(about 60°-80° C.) at the time of completion of the vacuum evaporation to 30° C.

The temperature of the substrate surface is measured by attaching a Pt-Pt-Rh resistor thermometer (of sheet form) to the surface of the substrate. As to the cooling of the substrate after the vacuum evaporation, it is sufficient that cold water at various temperatures (−20° C. to 30° C.) is injected into the mandrel and circulated therethrough while introducing air into the vacuum tank, and the substrate is allowed to cool. The heat transfer from the mandrel is remarkably improved by the introduction of air, and the temperature of the substrate coincides with the temperature of cold water in the mandrel just as the pressure in the vacuum room becomes equal to atmospheric pressure.

Figure 5:
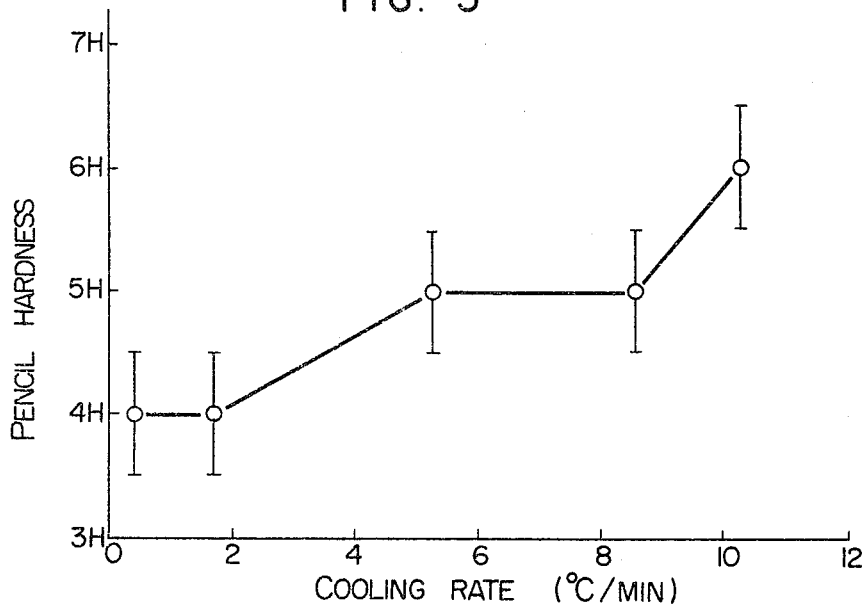
FIG. 5 is a graph showing the relationship between the cooling rate and the pencil hardness of the photoconductive layer.

When an age-hardening type aluminum alloy (having a hardness of 60 Hv) is used as the substrate, there is a relationship shown in FIG. 5 between the pencil hardness of the photoconductive layer surface and the cooling rate. The age-hardening type aluminum alloy used in this case has a composition: Al-(0.20–0.6%)Si-(0.45–0.9%)Mg (JIS A-6063).

As is obvious from FIG. 5, in order to make the surface hardness of the photoconductive layer 5H or higher in terms of the pencil hardness, it is necessary to adjust the cooling temperature to 5° C./min. or higher.

For cooling the substrate and the photoconductive layer, there may be used as a cooling medium very-low-temperature refrigerants such as liquid nitrogen, liquid helium, and the like other than cold water, and as the cooling gas, inert gases such as nitrogen gas, argon and the like may be used other than air. Although the mechanism of hardening of the surface is not completely theoretically clear, it can be explained as follows in the case of selenium. In the step of film formation on the substrate by vacuum evaporation of selenium, selenium evaporated as molecular selenium condenses on the substrate, and goes through a cooling step to give a photoconductive layer. In order to obtain good electrophotographic characteristics, it is necessary to heat the substrate to a temperature equal to or higher than the softening point of selenium and lower than its crystallization temperature. Therefore, the selenium which has condensed on the substrate is in a soft condition during the vacuum evaporation, and by rapidly cooling it from said condition to a temperature lower than the softening point, the internal stress and the like at the time of film formation are retained as they are, and the selenium becomes a photoconductive layer having a hard structure. The substrate should be tough as a receptor of a stress produced in the film of selenium, that is, it should be resistant to external stress. This means that the substrate is required to have good mechanical properties, namely, a high hardness. The high hardness of the substrate results in an improvement in mechanical properties of the substrate and imparts excellent properties to the electrophotographic plate.

Aluminum alloy substrates heretofore used are of non-age-hardening type and have a hardness of 25 to 40 Hv in terms of Vickers hardness, however it was found that when such substrates were used, the surface hardness of the photoconductive layer could not be adjusted to a hardness of 5H or higher in terms of the pencil hardness, however high the cooling rate was made.

Figure 6:
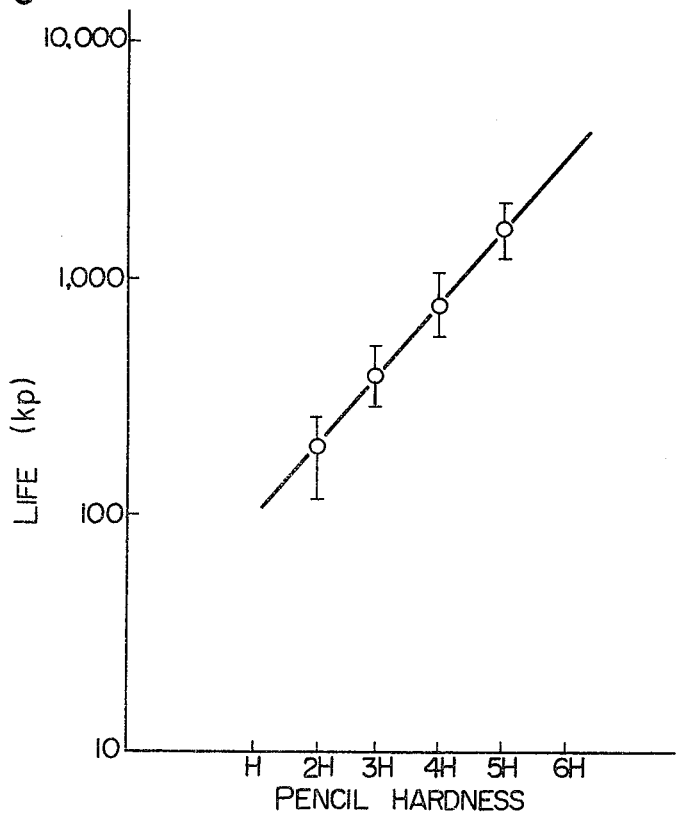
FIG. 6 is a graph showing the relationship between the pencil hardness of the photoconductive layer and the life in printing.

There is a relationship shown in FIG. 6 between the surface hardness (pencil hardness) of the photoconductive layer and the life ($\times 10^3$ pages) in printing, i.e., the life (number of printed pages) in a laser printer.

The recording paper used was a 55 Kg paper.

The number of printed pages increases with an increase of the pencil hardness, and the electrophotographic plate is required to have a hardness of 5 H or higher for withstanding printing of one million and five hundred thousand pages for a single electrophotographic plate. It is clear from this that the life of the electrophotographic plate is greatly prolonged by making its hardness high.

As is evident from the above description, an electrophotographic plate having a high hardness can be obtained by using an age-hardening type Al alloy having a Vickers hardness of 60 Hv or higher as a substrate of the electrophotographic plate and cooling the substrate to a temperature near the softening point of the photoconductive layer at a cooling rate of 5° C./min or more after vacuum evaporating a Se series photoconductive layer onto the substrate, that is, there can be obtained an electrophotographic plate having remarkably improved printing performance characteristics and a long life.

This invention is further explained below in more detail referring to Examples.

Example 1

An electrophotographic plate was obtained according to the process shown in FIG. 3. That is to say, an extruded tube having a composition of Al-(0.20–0.60%-)Si-(0.45–0.9%)Mg was used as a substrate of the electrophotographic plate, and subjected to rough working by means of a lathe, leaving a margin for shaving of 3 mm to the desired dimensions (261.8 mm in diameter and 260 mm long). Thereafter, age-hardening heat treatment was carried out at about 205° C. for 1 hour (Vickers hardness: 60 Hv), after which the surface of the substrate was subjected to precise working to be made specular and to finish the substrate to the desired dimensions, and the substrate was subjected to washing treatment. Subsequently, a photoconductive layer (Se) was vacuum evaporated onto the substrate. The evaporation conditions were as follows: the evaporation boat temperature was 300° C.; the evaporation rate was about 1 μm/min.; and the substrate temperature was 60° to 80° C. After completion of the vacuum evaporation, the substrate and photoconductive layer were rapidly cooled (about 10° C./min.) by injecting a refrigerant into the mandrel, a substrate holder in the vacuum tank and simultaneously introducing air into the vacuum tank, whereby an electrophotographic plate having a photoconductive layer with a pencil hardness of 5H was obtained. The eccentricity after the working of the drum was 0.03 mm or less.

Example 2 and Comparative Example

Selenium was used as a photoconductive layer, and as substrates, there were used pure aluminum having a Hv of 25 to 30, a conventional Al alloy (JIS 3003) having a composition of (0.05–0.20%)Cu-(1.0–1.5%)Mn and a Hv of 40, and an Al-(0.45–0.9%)Mg-(0.20–0.60%)Si alloy materials having Hv of 60 and 80, respectively.

For vacuum evaporation of selenium, a mandrel type vacuum evaporating apparatus equipped with a substrate-rotating device and a heating-cooling device was used as in Example 1. The surface of the substrate drum was subjected to precise working to be made specular, and the substrate was subjected to defatting and washing treatment, after which selenium was evaporated onto the substrate. As to the evaporation conditions, the substrate temperature was maintained at 60° to 80° C. which was equal to or higher than the softening point of selenium and lower than its crystallization temperature, and selenium was vacuum evaporated onto the substrates having various hardnesses at a selenium evaporation rate in the range from 0.85 to 1.25 μm/min. After completion of the vacuum evaporation, cold water was immediately circulated through the mandrel while introducing air into the vacuum tank, whereby cooling was conducted to produce an electrophotographic plate.

Next, the relationship between the substrate hardness, the cooling rate and the surface hardness of the photoconductive layer as measured by a pencil hardness test method is shown in Table 2. The aforesaid electrophotographic plate was set in a high-speed non-impact printer and subjected to a printing test, and the resistance to mechanical damages and the printing property of the substrates having each of the hardnesses were observed and compared with those of an electrophotographic plate having a substrate hardness Hv of 40 and a surface hardness of 3H which shows the present situation of the art. The results are shown in Table 3.

TABLE 2

| Cooling rate (°C./min.) | Substrate hardness (Hv) 25–30 | 40 | 60 | 80 |
|---|---|---|---|---|
| 0.4 | 2H | 2H | 3H | 4H |
| 1.7 | 2H | 3H | 4H | 4H |
| 5.0 | 3H | 4H | 5H | 5H |
| 8.6 | 3H | 4H | 5H | 6H |
| 10.3 | 3H | 4H | 6H | 6H |

TABLE 3

| Performance characteristics | Pencil hardness 2H | 3H | 4H | 5H | 6H |
|---|---|---|---|---|---|
| Resistance to mechanical damages | x | Δ | Δ | ○ | ◉ |
| Printing property | x | Δ | Δ | ○ | ◉ |

Δ: equal to conventional electrophotographic plates
x: inferior to conventional electrophotographic plates
○: better than conventional electrophotographic plates
◉: more excellent than conventional electrophotographic plates
Note
Conventional electrophotographic plates had a surface hardness of the substrate of 25 to 30 Hv and a surface hardness of the photoconductive layer of 3 H to 4 H.

As can be seen from the above-mentioned experiments, when a conventional substrate having a Vickers hardness of 25 to 40 Hv is used, the surface hardness increases with an inrease of the cooling rate of the substrate and the photoconductive layer, however when the cooling rate exceeds 5° C./min., the surface hardness reaches the equilibrium and its maximum is 4H. However when the substrate hardness exceeds 60 Hv, the surface hardness increases with an increase of the cooling rate, and becomes 5H at cooling rates of 5° C./min. and 8.6° C./min. and 6H at a cooling rate of 10.3° C./min. Therefore, the surface hardness is greatly dependent not only on the cooling rate but also on the substrate hardness, and it is difficult to increase the surface hardness of the photoconductive layer by using a conventional soft substrate. And it can be seen that in order to obtain a photoconductive layer having a high surface hardness, the conditions of a substrate hardness of 60 Hv or higher and a cooling rate of 5° C./min. or higher are needed.

In a printing test, the electrophotographic plates having a pencil hardness of 2H received scratches on the surface of the photoconductive layer owing to printing of several thousands pages, which scratches deteriorated the printing performance characteristics. The electrophotographic plates having pencil hardnesses of 3H and 4H began to receive scratches at about forty to fifty thousand pages, and were gradually deteriorated in the printing performance characteristics. The electrophotographic plates having pencil hardnesses of 5H and 6H received no scratches on the surface of the photoconductive layer even by printing of one hundred thousand pages, and were very good in printing performance characterstics.

The degree of eccentricity of the drum was 0.03 mm or less to the drum length of 430 mm.

Example 3

After rough working the same age-hardening type aluminum alloy as used in Example 1, age-hardening heat treatment was carried out at 205° C. for 60 minutes (Vickers hardness: 60 Hv). Subsequently, the surface of the resulting substrate was subjected to precise working so as to give the desired drum-like form having an outer diameter of 260 mm and an inner diameter of 250 mm, followed by washing treatment. The eccentricity of the drum along the longer direction was 0.03 mm or less.

On the other hand, a coating solution of charge generating material was prepared by ball milling a 6% by weight xylene solution obtained from 2 parts by weight of β-type phthalocyanine pigment (an organic photosensitizer, Fastogen Blue FGF, manufd. By Dainippon Ink and Chemicals, Inc., Japan) and 1 part by weight of a butyral resin (XYHL, manufd. by Union Carbide Corp., U.S.A.) for 5 hours using a ball mill (manufd. by Nippon Kagaku Togyo Co., Ltd., Japan). The resulting coating solution was coated on the drum by a dip coating method, followed by drying to give a layer of charge generating material (a charge generating layer). The thickness of this layer was about 3 μm.

In the next place, a thermosetting acrylic polymer was produced by the following method. In a 1-liter four-necked flask equipped with a stirrer, a nitrogen introducing tube, a thermometer, and a reflux condenser, 191 parts by weight of dried, distilled xylene was placed and heat to 136° C. while flowing nitrogen slowly. Then, a mixture of 135 parts by weight of methyl methacrylate, 80 parts by weight of ethyl acrylate, 30 parts of methacrylic acid, 55 parts by weight of the compound of the formula:

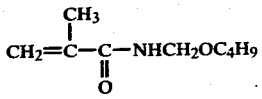

6 parts by weight of di-tert-butyl peroxide and 3 parts by weight of tert-dodecylmercaptane was added to the flask over 1.75 hours. The inner temperature was maintained at 136° C.–143° C. by adjusting the temperature of a mantle heater or blowing an air over the surface of the contents of the flask. Then, the temperature was lowered to 65° C. and 100 parts by weight of anhydrous ethanol was added thereto to give a solution of a thermosetting acrylic polymer. The solid content of this solution was 51.3% by weight. To 10 parts by weight of the above-mentioned solution, 2 parts by weight of epichlorohydrin-bisphenol A type epoxy resin (Epon 828, manufd. by Shell Chemical Co., U.S.A.) as a curing agent was added, followed by addition of toluene as a solvent to make the solid content 20% by weight. To the resulting solution, 10 parts by weight of a charge transporting material of the formula:

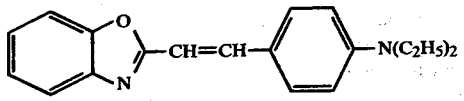

(NK-1347, manufd. by Japanese Research Institute for Photosensitizing Dyes, Ltd., Japan) was added and dissolved completely with stirring to give a coating solution of charge transporting material. The resulting solution was coated on the above-mentioned charge generating layer by using a dip coating method. After coating, the resulting drum was allowed to stand in a drier at 100° C. for 30 minutes to remove the solvent, and then the drier temperature was raised to 130° C. and maintained at that temperature for 1 hour to cure the sticking agent resin. The resulting charge transporting layer had a thickness of 10 μm.

The resulting electrophotographic plate was installed in a laser printer. When a printing test was conducted, clear images were obtained. Particularly, the eccentricity of the substrate drum before the coating of photoconductive layer was very small, which resulted in improving the yield of production of the substrate drum.

As mentioned above, when a substrate is made of an age-hardening type aluminum alloy and subjected to age-hardening heat treatment, followed by forming an inorganic or organic photoconductive layer thereon to give an electrophotographic plate, the yield of the production of substrtes is improved and also there are obtained clear printed images as well as long life in printing. Thus, the age-hardening type aluminum alloy is most suitable as an electroconductive substrate having a photoconductive layer thereon including inorganic and organic complex type photoconductive layers in electrophotographic method.

As is evident from the explanation given above, the electrophotographic plate obtained has been improved in dimensional precision by using as a substrate an age-hardening type aluminum alloy having a hardness of 60 Hv or higher, and when the substrate is molded and worked into drum form, the eccentricity becomes slight and hence there is obtained such an effect that the yield in the drum production is greatly improved. By simultaneous use of the conditions of a substrate hardness of 60 Hv in terms of Vickers hardness and a colling rate of the substrate and the photoconductive layer of 5° C. per minute or higher, it becomes possible to obtain under the above-mentioned evaporation conditions an electrophotographic plate having a photoconductive layer with a surface hardness of 5H or higher which is higher than that of conventional ones, and hence there can be obtained an electrophotographic plate which is excellent in resistance to mechanical damages and has been given a long life without deteriorating the printing performance characteristics.

What is claimed is:

1. An electrophotographic plate comprising a substrate made of an age-hardening type aluminum alloy having a surface hardness of 60 Hv or higher in terms of Vickers hardness and a photoconductive layer made of amorphous selenium or a selenium alloy formed on the substrate by a vacuum evaporation method; said photoconductive layer and said substrate then having been cooled at a rate of 5° C/min. or higher.

2. An electrophotographic plate according to claim 1, wherein the age-hardening type aluminum alloy is an Al-Mg-Si alloy, an Al-Cu alloy, an Al-Si-Mg-Ni alloy or an Al-Mn-Mg-Zn alloy.

3. An electrophotographic plate according to claim 1, wherein the photoconductive layer has a surface hardness of 5H or higher in pencil hardness.

4. An electrophotographic plate according to claim 1 or 3, wherein the electrophotographic plate is in the form of a plate.

5. An electrophotographic plate according to claim 1 or 3, wherein the electrophotographic plate is in the form of a drum.

6. A process for producing an electrophotographic plate which comprises subjecting an age-hardening type aluminum alloy to an age-hardening heat treatment to obtain a substrate having a hardness of 60 Hv or higher in terms of Vickers hardness, subjecting the surface of said substrate to precise working, vacuum-evaporating amorphous selenium or a selenium alloy onto said substrate surface to form a photoconductive layer, and then rapidly cooling the thus obtained substrate and photoconductive layer at a cooling rate of 5° C./min. or higher.

7. A process according to claim 6, wherein the rapid cooling after the formation of the photoconductive layer is conducted under reduced pressure or under atmospheric pressure.

8. A process according to claim 6 or 7, wherein the rapid cooling is conducted at a cooling rate of 5° C./min. or higher.

* * * * *